US005946885A

United States Patent [19]

Focke et al.

[11] Patent Number: 5,946,885

[45] Date of Patent: Sep. 7, 1999

[54] CIGARETTE PACKAGING MACHINE INCLUDING A ROTARY FOLDING TURRET HAVING TWO RELEASABLY INTERCONNECTED TURRET PORTIONS

[75] Inventors: Heinz Focke, Verden; Hans-Jürgen Bretthauer, Bremen; Peter Verwiebe, Berlin, all of Germany

[73] Assignee: Focke & Co. (GmbH & Co.), Verden, Germany

[21] Appl. No.: 09/018,183

[22] Filed: Feb. 3, 1998

[30] Foreign Application Priority Data

Feb. 18, 1997 [DE] Germany ..... 197 06 215

[51] Int. Cl.[6] ..... B65B 11/28

[52] U.S. Cl. ..... 53/234; 198/397.02

[58] Field of Search ..... 53/234, 225, 201, 53/169, 228, 232; 414/444, 427; 198/473.1, 803.11, 397.02, 397.03

[56] References Cited

U.S. PATENT DOCUMENTS

| | | | |
|---|---|---|---|
| 3,055,490 | 9/1962 | Anderson | 53/234 |
| 3,978,639 | 9/1976 | Ferrozzi | 53/32 |
| 4,056,207 | 11/1977 | Spilker | 214/652 |
| 4,258,526 | 3/1981 | Focke | 53/399 |
| 4,790,115 | 12/1988 | Focke | 53/234 |
| 4,947,617 | 8/1990 | Focke et al. | 53/234 |
| 5,378,004 | 1/1995 | Gunlock et al. | 280/47.2 |
| 5,699,893 | 12/1997 | Spada | 198/478.1 |
| 5,806,289 | 9/1998 | Sassi et al. | 53/575 |

FOREIGN PATENT DOCUMENTS

| | | |
|---|---|---|
| 3573 | 2/1979 | European Pat. Off. . |
| 165204 | 4/1985 | European Pat. Off. . |
| 416440 | 8/1990 | European Pat. Off. . |
| 756996 | 8/1995 | European Pat. Off. . |
| 728666 | 2/1996 | European Pat. Off. . |
| 2502937 | 7/1975 | Germany . |
| 1929666 | 7/1981 | Germany . |
| 3545884 | 7/1987 | Germany . |
| 196 05 354 | 8/1996 | Germany . |

*Primary Examiner*—Joseph J. Hail, III
*Assistant Examiner*—Ed Tolan
*Attorney, Agent, or Firm*—Sughrue, Mion, Zinn, Macpeak & Seas, PLLC

[57] ABSTRACT

Packaging machine for producing cigarette packs, having a folding turret (10), on the circumference of which there are arranged receiving means or pockets (26) for packaging material and pack contents along with movable folding elements and other elements assigned to the receiving means or pockets (26). The folding turret (10) is subdivided into a plurality of, in particular two, sub-turrets (17, 18) which are positioned equiaxially one beside the other in the axial direction and are connected releasably to one another. Each sub-turret (17, 18) can be handled, in particular removed, separately.

18 Claims, 7 Drawing Sheets

CIGARETTE PACKAGING MACHINE INCLUDING A ROTARY FOLDING TURRET HAVING TWO RELEASABLY INTERCONNECTED TURRET PORTIONS

BACKGROUND OF THE INVENTION

The invention relates to an apparatus for producing packs, in particular cigarette packs, having at least one rotationally driven folding turret, on the circumference of which there are arranged a plurality of pockets or receiving means for packaging material and pack contents as well as folding elements and other elements assigned to the pockets or receiving means.

Packaging machines for small packs such as cigarette packs are usually equipped with at least one folding turret which, during cyclic or continuous rotation, performs folding and filling steps for the production of the packs. Arranged on the circumference of a folding turret are receiving means, pockets or retaining means for blanks and pack contents. Each receiving means or pocket contains elements which perform the folding of the packaging material, displacement movements or filling operations, in order to finish the packs wholly or partially in the region of the folding turret. In particular in the case of continuously rotating folding turrets, all the tools or elements for the production process of the packs are arranged on the folding turret and are assigned, as a complete set, to each pocket or each receiving means. The folding turrets are thus of an extremely complex construction, which is disadvantageous, in particular, for the exchange of worn parts and for format changes (of the packs).

SUMMARY OF THE INVENTION

The object of the invention is thus to develop a packaging machine further as regards the construction and the handling of folding turrets and other turrets, and to improve the packaging machine so as to facilitate measures on the folding turret.

In order to achieve this object, the packaging machine according to the invention is characterized in that the folding turret is subdivided in a plane perpendicular to the axial direction, at least two sub-turrets, arranged one beside the other in the axial direction and connected releasably to one another, being formed in the process.

The axial dimensions of the complex turrets are considerable, and this makes handling more difficult. The subdivision into a plurality of, namely preferably two, sub-turrets facilitates handling since each sub-turret can be handled as an independent unit during installation and removal. A particularly significant advantage is that, for exchanging worn parts or for format changes, each sub-turret can be handled, that is to say removed from the packaging machine and replaced by another sub-turret, on its own. Given a certain stock of exchangeable replacement folding turrets or sub-turrets, errors, wear or format changing only cause the operation of the packaging machine to be brought to a standstill for a brief period of time.

The subdivision of the folding turret into the sub-turrets takes place according to functional aspects such that a sub-turret has a complete set of pockets or receiving means along with the folding elements and other elements assigned to the latter, as well as the drive therefor. The sub-turrets are connected releasably to one another by a central load-bearing element. One sub-turret is connected, on the free side, to the packaging machine or a machine framework. The other sub-turret, or outer sub-turret, is supported by a load-bearing part at the free, outer end.

A further concern of the invention is the handling of the folding turrets or of the sub-turrets. Provided for this purpose is a mobile load-bearing framework which can receive the folding turret as a unit, or can receive a sub-turret, and can displace the same once the folding turret or sub-turret has been released from the machine framework or from the other sub-turret, respectively. The load-bearing framework is equipped with a travelling mechanism and retaining elements which can be moved up and down and are intended for the folding turret or a sub-turret.

Further features of the invention relate to the configuration of the packaging machine or of the machine framework and sub-turrets. Furthermore, features of the invention are concerned with the configuration of the mobile load-bearing framework for the folding turret or sub-turrets.

BRIEF DESCRIPTION OF THE DRAWINGS

Exemplary embodiments are explained in more detail hereinbelow with reference to the drawings, in which.

DESCRIPTION OF A PREFERRED EMBODIMENT

Figure 1:
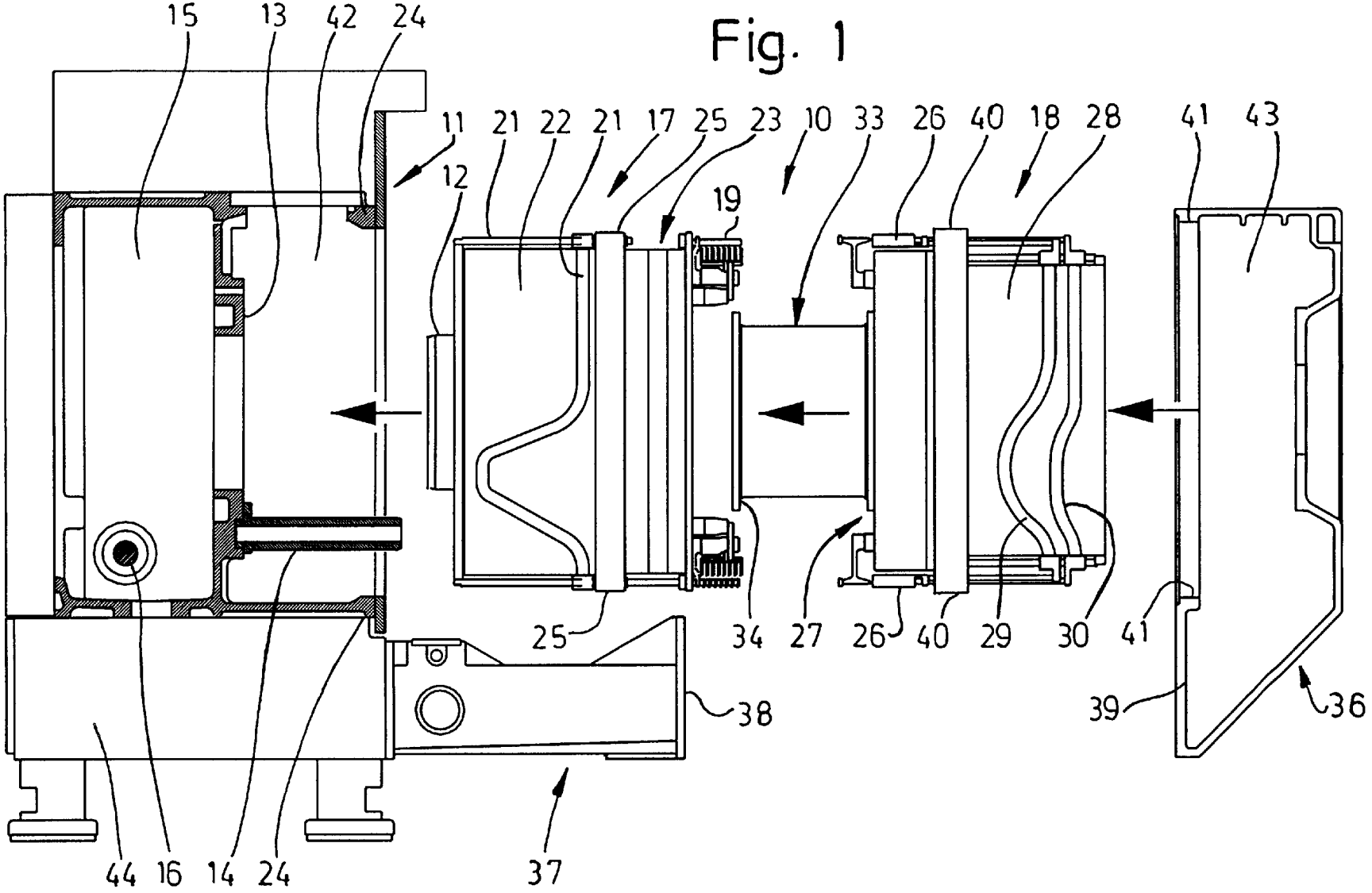
FIG. 1 shows a packaging machine with sub-turrets in cross-section and side view, with the sub-turrets removed.

The exemplary embodiment of a packaging machine which is illustrated in the drawings is geared towards producing cigarette packs of the soft-carton type. With this type of pack, an inner wrapper made of tin foil, paper or the like fully surrounds a cigarette group. A resulting cigarette block is positioned in a carton-like outer wrapper, which is thus open at the top and is made of paper or similar packaging material. This pack, which comprises two blanks, is produced entirely on a folding turret 10.

The folding turret 10 is part of a packaging machine, of which part of the machine framework 11 can be seen in cross-section in FIG. 1. The essentially cylindrical folding turret 10 is mounted rotatably on the machine framework 11 such that it projects on one side. A coaxial, cylindrical load-bearing body of the folding turret 10 projects out of the folding turret 10, on the side facing the machine framework 11, and serves for mounting in a bearing ring 13 of the machine framework 11. In order to absorb the high loading from the dead weight of the folding turret 10, the folding turret 10 is additionally supported on the machine framework, to be precise by preferably two load-bearing members 14 which are spaced apart one beside the other. These pass into the bottom region of the folding turret 10 and support the latter in a recess of a fixed, that is to say non-rotating, part thereof. The load-bearing members 14 are connected to the machine framework 11.

The machine framework 11 is designed such that, in the installed position, a gear chamber 15 is formed alongside the folding turret 10. The drive elements for the folding turret 10 are accommodated in this region. A main shaft 16 extends in the bottom region of the gear chamber 15.

The folding turret 10 comprises a plurality of, namely two, sub-turrets 17, 18. In the assembled, installed position, these form together the folding turret 10. The subdivision into the (two) sub-turrets 17, 18 facilitates installation and removal of the folding turret 10 for repair or exchange purposes.

The subdivision of the folding turret 10 into the sub-turrets 17, 18 is selected such that functionally associated elements are arranged in the region of one or the other of the sub-turrets 17, 18.

For the production of cigarette packs of the soft-carton type, the sub-turret 17, which is assigned to the machine framework 11, is equipped with receiving means for the blanks of the packaging material, on the one hand, and for the cigarette groups, on the other hand. These receiving means are folding mandrels 19, that is to say hollow, thin-walled elements on the outside of which the blanks are folded one after the other and which receive the cigarette group internally. The folding mandrels 19 are assigned folding elements, pressure-exerting elements and slides. These are arranged entirely on the sub-turret 17. Elements which can be moved in the axial direction of the folding turret 10 or sub-turret 17, for example an elongate push rod 20 for pushing the cigarette group out of the folding mandrel 19, the folded blanks being carried along in the process, are arranged, by way of a control curve 21, on a fixed load-bearing body 22 of the folding turret 10. The folding mandrels 19 with the associated folding elements, push rods, etc. are fitted on a body of rotation 23 of the folding turret 10. Said body of rotation additionally has its outer circumference supported on the machine framework, to be precise on an annular sealing surface 24 of the machine framework 11 or of the machine housing. The (rotatable) counterpart of the folding turret 10 is a sealing ring 25 on the rotatable part, that is to say on the body of rotation 23 of the folding turret 10.

The second, equiaxial sub-turret 18, which is offset in the axial direction, has the task of receiving the unfinished pack in the region of the sub-turret 17 and finishing it by further folding operations. For this purpose, the sub-turret 18 is likewise provided on the outer circumference with retaining means for packs or packaging material, namely with pockets 26 which each receive a pack from an associated folding mandrel 19. As can be seen from FIG. 2 at the bottom, the pockets can all be displaced in an axis-parallel direction, namely as far as the folding mandrel 19, in order to receive an unfinished pack.

The pockets 26, along with associated folding elements, retaining elements and slide elements, are all positioned on the outer circumference of the sub-turret 18, to be precise on a body of rotation 27. As is the case for the sub-turret 17, said body of rotation is mounted rotatably on a fixed load-bearing body 28. Control grooves 29, 30, inter alia, are arranged on the load-bearing body 28 for the purpose of controlling elements which can be displaced in an axis-parallel direction. Thus, a slide 31 can be actuated by the control groove 29 in order to displace the pockets 26 in an axis-parallel direction. A push rod 32 is assigned to the control groove 30.

The two sub-turrets 17, 18 are connected releasably to one another. For this purpose, a connecting part 33 is provided centrally or concentrically. This is a cylinder part with connecting flanges 34, 35 at the two ends. The connecting flanges 34, 35 are connected releasably, for example via screw-bolts, to part of each of the sub-turrets 17, 18. Accordingly, the sub-turrets 17, 18 can be separated from one another by the screws or other connecting elements being released, it being possible for the connecting part 33 to remain on either of the sub-turrets 17, 18 or to be removed. In the case of the present exemplary embodiment, the rotatable parts of the sub-turrets 17, 18, that is to say the two bodies of rotation 23 and 27, are connected to one another by the connecting part 33. In this way, the rotary drive is thus transmitted from one sub-turret 17 to the other sub-turret 18.

The outer sub-turret 18, that is to say the sub-turret which is remote from the machine framework 11, is additionally supported, to be precise by a supporting element at its end in the form of a supporting housing 36. This fixed hollow body is supported at the bottom, to be precise on a protruding or extending load-bearing part 37 which is connected on one side to the machine framework 11 or the machine housing. The load-bearing part 37 is expediently a casting and is designed as a hollow body. In the installed position, the supporting housing 36 is connected releasably to the load-bearing part 37. An end-side connecting plate 38 serves for the abutment and releasable connection of a mating plate 39 of the supporting housing 36. The latter is connected to the load-bearing part 37, for example, by screwed connections.

The sub-turret 18 is supported in the supporting housing 36 analogously to the way in which the sub-turret 17 is mounted in the machine framework 11, namely by an outer, co-rotating sealing ring 40 which butts against a corresponding mating surface, namely an annular sealing surface 41 of the supporting housing 36, with the result that the sub-turret 18 projects into the supporting housing 36, to be precise by way of the load-bearing body 28 in particular.

The sealing surface 24 with sealing ring 25 of one sub-turret 17 and the sealing ring 40 and the sealing surface 41 of the other sub-turret 18 delimit regions of the folding turret 10 which are enclosed and run in oil or to which oil is added constantly for lubricating purposes. These regions are, in particular, the regions in which the control curve 21 and the control grooves 29, 30 are arranged, that is to say the load-bearing bodies 22, 28. Control rollers run in the latter in order to actuate the axially displaceable elements. For the sub-turret 17, which faces the machine framework 11, this enclosed chamber 42 is formed within the machine housing or machine framework 11. A corresponding chamber 43 is located within the supporting housing 36. The last-mentioned chamber 43 is connected to an oil trough 44 in the bottom part of the machine framework via the load-bearing part 37, which is designed as a hollow body. The chamber 42 also adjoins said oil trough 44, the result being a closed oil circuit for the two sub-turrets 17, 18.

Figure 2:
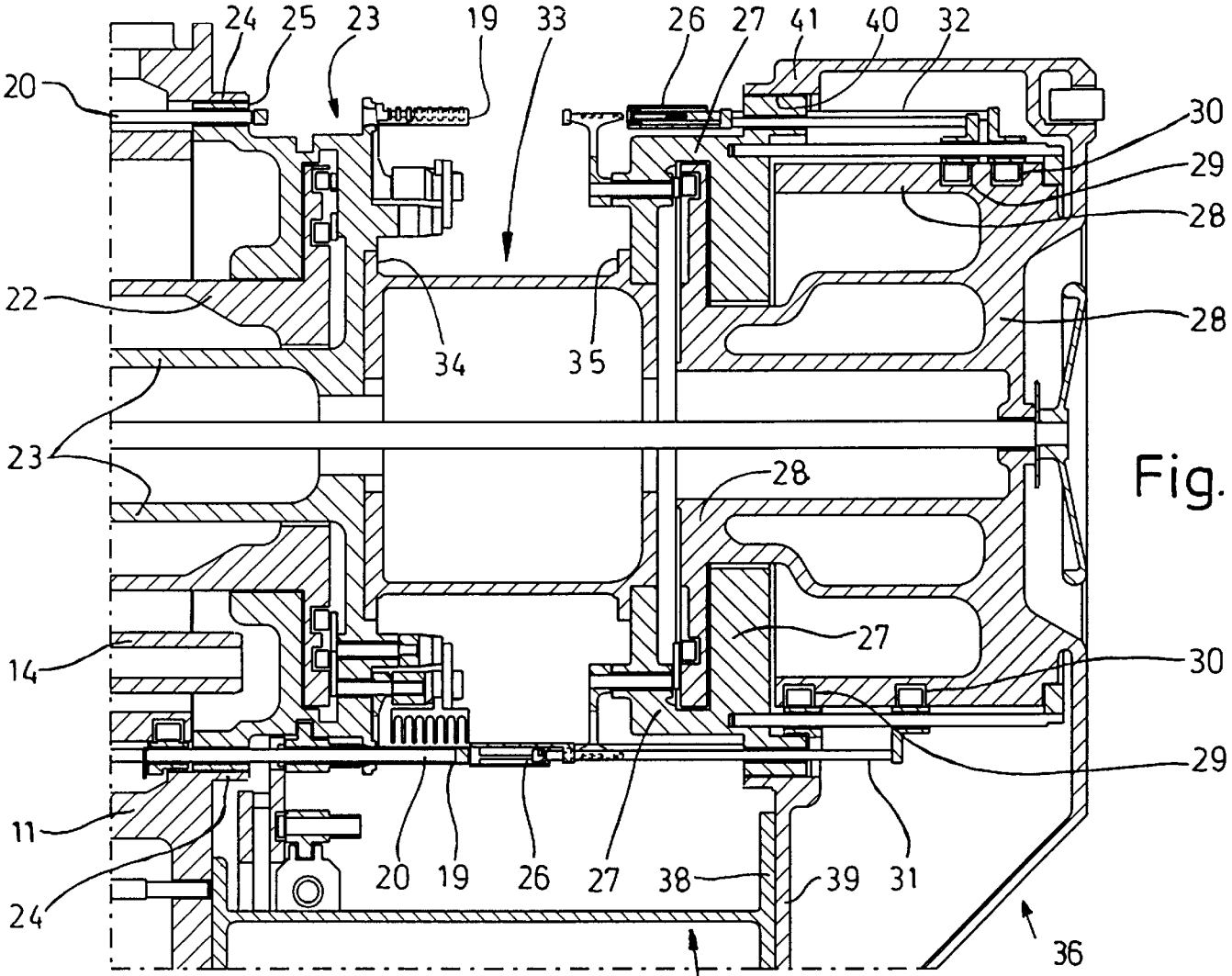
FIG. 2 shows, on an enlarged scale, a longitudinal section through a folding turret or part thereof.
Figure 3:
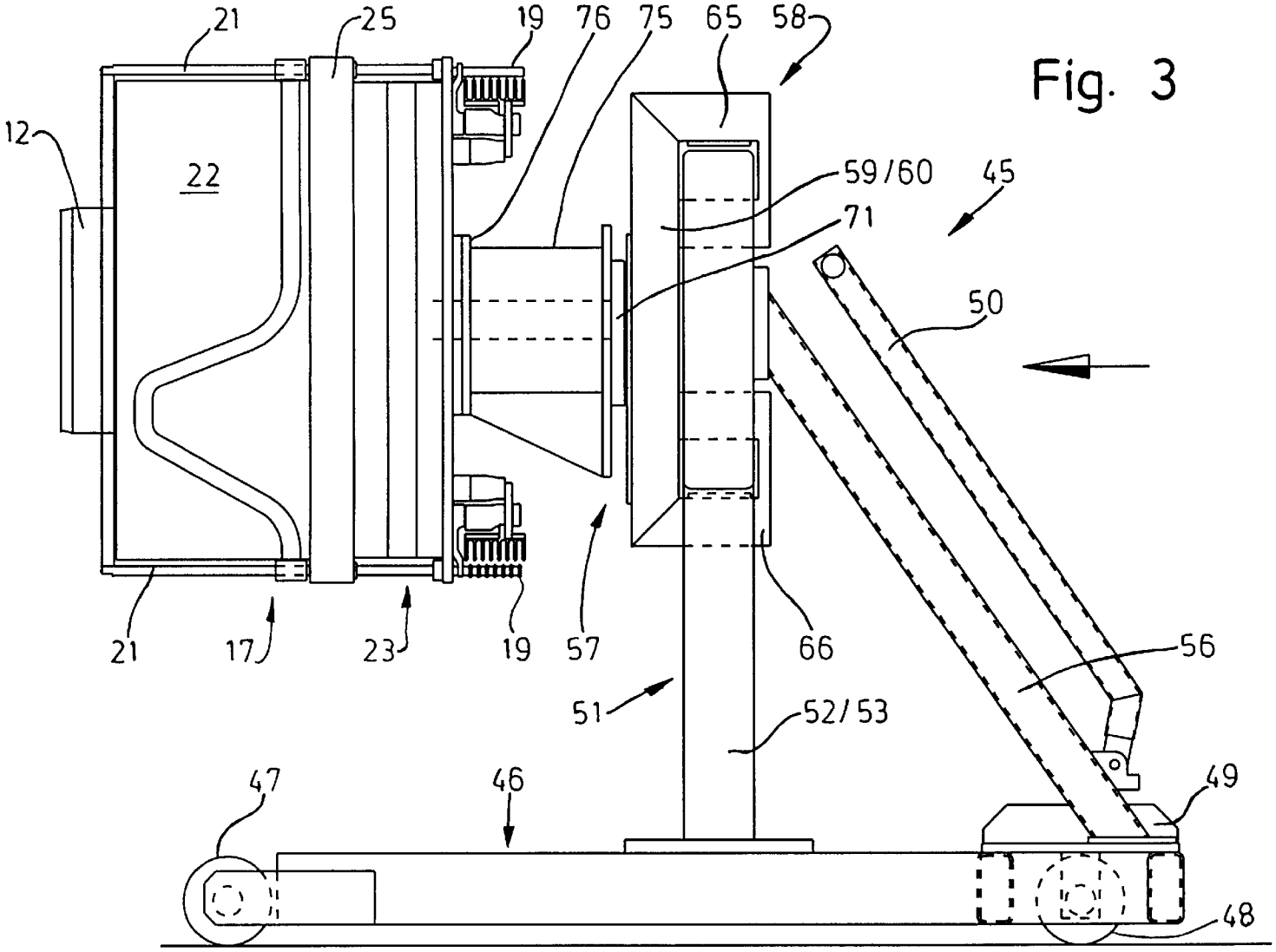
FIG. 3 shows a side view of a load-bearing means for a folding turret or sub-turrets.

As is shown in FIG. 2, the supporting housing 36 may be connected integrally to the sub-turret 18, namely to the load-bearing body 28 thereof. However, the design according to FIG. 1, in which the supporting housing 36 is an independent hollow body which can be removed from the sub-turret 18, is advantageous.

The entire folding turret 10 or—preferably—the folding turret with its sub-turrets 17, 18 may be removed from the packaging machine or the machine framework 11 and stored separately, in order for repair or exchange work to be carried out. In order to reduce the periods during which the packaging machine is at a standstill, it is possible, with such measures, for the relevant folding turret 10 or sub-turrets 17, 18 to be replaced by an exchange turret, with the result that the packaging machine is only at a standstill during the period which it takes to remove and fit the sub-turrets 17, 18.

In order to carry out the abovedescribed measures, the invention provides a mobile handling unit 45 which, in the present case, serves for receiving in each case one sub-turret 17, 18. The handling unit 45 comprises a bottom travelling mechanism 46, which is designed as a frame and has four running rollers 47, 48. Front running rollers 48 are mounted on a rotary part 49 and thus act as steering rollers. A pivotable shaft 50 is connected to the rotary part 49 and permits (manual) displacement and steering of the handling unit 45. An upright load-bearing framework 51 is arranged, approximately centrally to be precise, on the travelling mechanism 46 or the load-bearing frame thereof. The load-bearing framework 51 is designed as a frame with upright supports 52, 53, a top transverse carrier 54 and an intermediate carrier 55 which is likewise directed transversely and is located approximately half way up and as a connection between the supports 52, 53. On one side, namely towards the shaft 50, the load-bearing framework 51 is secured by sloping supports 56 in the region of the supports 52, 53.

A moveable load-bearing means 57 for receiving the folding turret 10 or the sub-turrets 17, 18 is fitted on the handling unit 45. The load-bearing means 57 is fitted on the load-bearing framework 51, to be precise on the transverse carrier 54 and on the intermediate carrier 55. In the present case, the load-bearing means 57 can be adjusted in the vertical direction and in the horizontal direction.

The load-bearing means 57 is provided with a receiving frame 58 for folding turret 10 or sub-turrets 17, 18, this receiving frame being mounted displaceably on the transverse carrier 54 at the top and on the intermediate carrier 55 at the bottom. The receiving frame 58 essentially comprises upright load-bearing struts 59, 60 which are connected to one another by top and bottom transverse struts 61, 62. Further transverse profiles 63, 64 serve for fitting coupling parts for the purpose of gripping the folding turret 10 or a sub-turret 17, 18. The receiving frame 58 is mounted displaceably on the transverse carrier 54 and on the intermediate carrier 55. For this purpose, the receiving frame 58, which is positioned alongside or in front of the load-bearing framework 51, is supported on the top side of the top transverse carrier 54 and on the underside of the intermediate carrier 55 by transversely directed load-bearing legs 65, 66. The load-bearing legs 65, 66 are part of a closed surround profile which surrounds the transverse carrier 54 and intermediate carrier 55.

The load-bearing legs 65, 66 are supported on the top side of the transverse carrier 54, and on the underside of the intermediate carrier 55, such that they can be displaced in a sliding manner. On the abutment sides, the load-bearing legs 65, 66 are each provided with a sliding plate 67. These butt against plate-like sliding elements 68 of the transverse carrier 54 and of the intermediate carrier 55. The sliding elements 68 consist, in particular, of brass, and are thus brass plates.

Slide elements 69 are also arranged on those sides of the transverse carrier 54 and of the intermediate carrier 55 which face the load-bearing struts 59, 60 and serve for possibly supporting the load-bearing struts 59, 60 on these transverse profiles in a sliding manner.

Provided in the present case for the transversely directed movement of the load-bearing means 57 is a spindle drive 70 which is arranged on the top side of the transverse carrier 54. A rotatable spindle passes into a spindle nut of the load-bearing means 57, namely of the load-bearing leg 65.

Provided for the purpose of mounting a sub-turret 17, 18 on the handling unit 45 such that it can project on one side are special coupling elements which are coordinated individually with the configuration of the sub-turrets 17, 18. The respective connecting elements are attached releasably, in particular via screwed connections, to a retaining part 71 which is fitted on the load-bearing means 57, to be precise such that it can be moved with respect to the latter. In the present case, only a vertical movement of the retaining part 71 is provided for, to be precise by means of an upright spindle 72. The latter is positioned in the centre of the load-bearing means 57 and, by way of its top and bottom ends, is mounted rotatably in the transverse profiles 63, 64 in each case. Rotation of the upright spindle 72 causes an extension 73, designed as a spindle nut, to move up and down on the retaining part 71.

In the present case, the spindle drive 70 and the spindle 72 are set up for manual actuation via a tool which acts on a head 89, 90 of the spindles.

On the free side, the retaining part 71 is provided with a load-bearing plate 74 which, in the present case, is circular. A suitable coupling or load-bearing part may be attached thereto, for example by screwed connection.

A cylindrical coupling part 75 is provided for receiving, gripping and transporting the sub-turret 17. Said coupling part is positioned centrally with respect to the sub-turret 17. One side is connected to the retaining part 71 and the other side is connected releasably to the sub-turret 17 via a flange 76. The flange 76 may be attached at the same location at which, in the case of a folding turret 10 according to FIG. 2, the connecting flange 34 of the connecting part 33 is fastened, that is to say likewise via screwed connections. The connection thus takes place in the region of the body of rotation 23.

Figure 4:
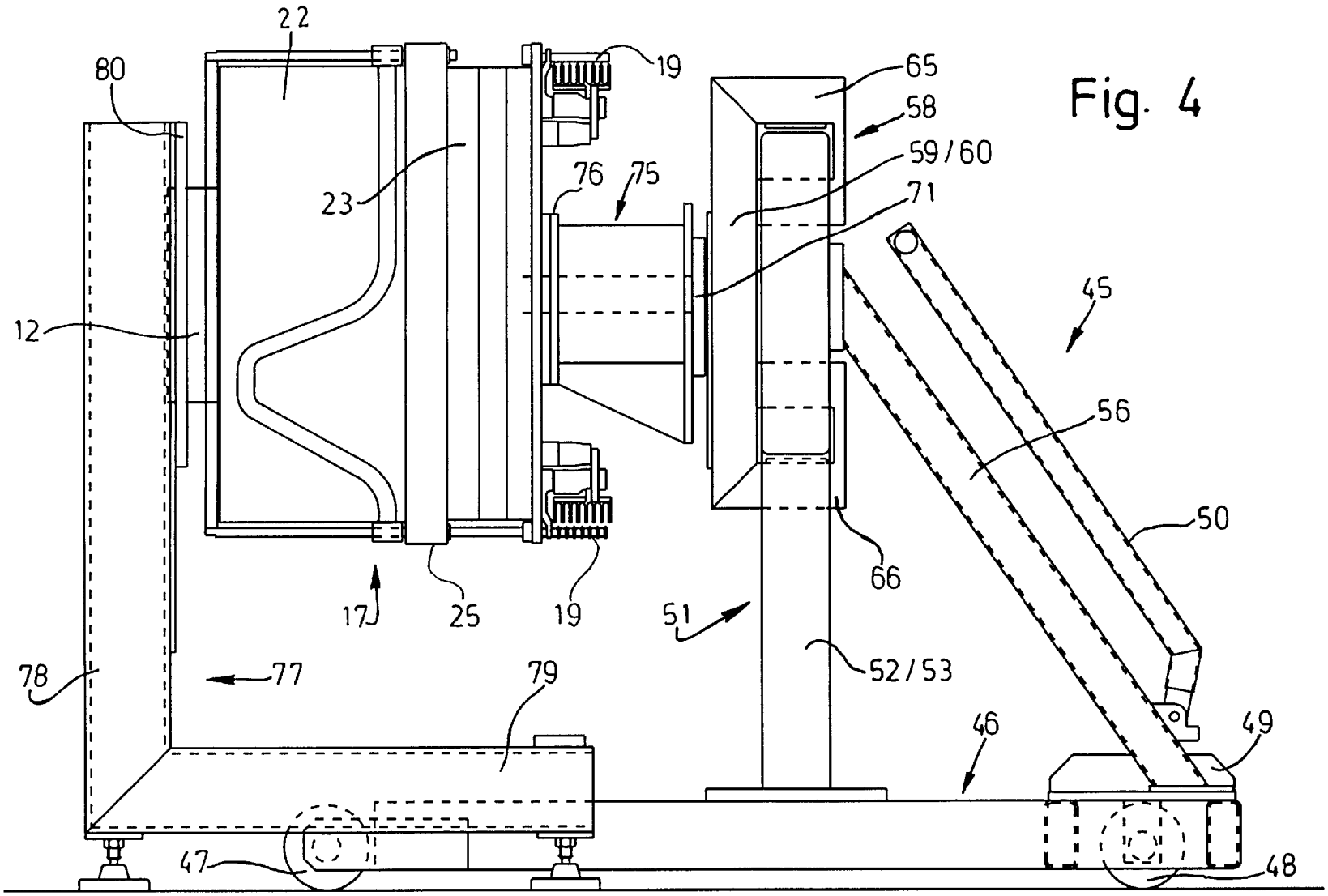
FIG. 4 shows the means according to FIG. 3 during transfer of a sub-turret to a stationary load-bearing framework.

The handling unit 45 can displace the sub-turret 17, positioned on the load-bearing framework 51 such that it projects on one side, for example into a processing station. In the latter, the sub-turret 17 is stored intermediately and removed from the handling unit 45. According to FIG. 4, this storage and installation station is provided with a stationary load-bearing structure 77. In the present exemplary embodiment, this structure is of angled design with an upright retaining leg 78 and a horizontal supporting leg 79. Coupling elements, in this case an installation plate 80, are fitted on the upright retaining leg 78 for the releasable fastening of the sub-turret 17. That part of the load-bearing body 12 which projects out of said sub-turret 17 serves here for the purpose of fastening to the installation plate 80. The rotatable or moveable parts of the folding turret 10 can likewise be moved in the installed position.

Figure 5:
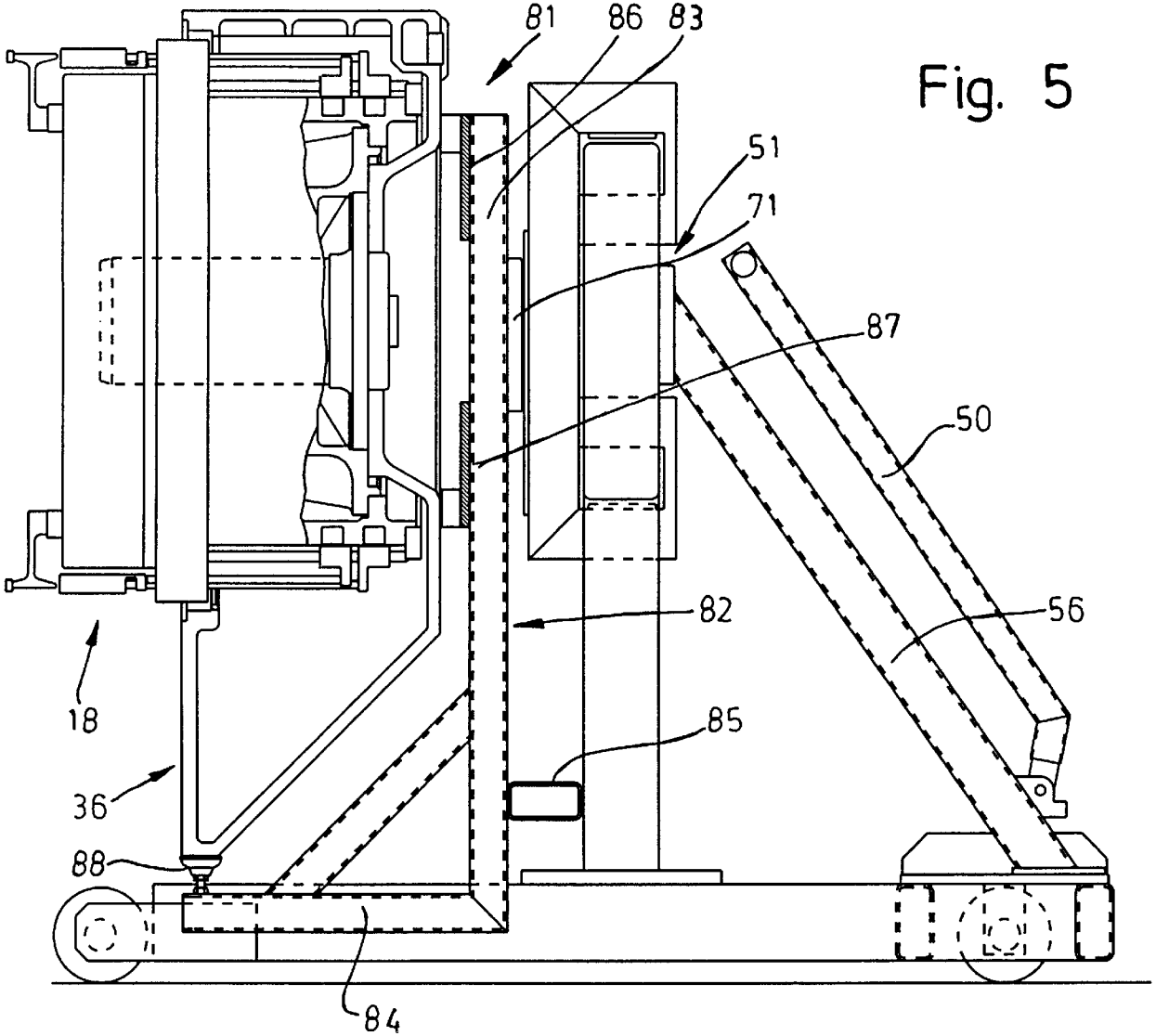
FIG. 5 shows the means according to FIGS. 3 and 4 set up for receiving another sub-turret.
Figure 6:
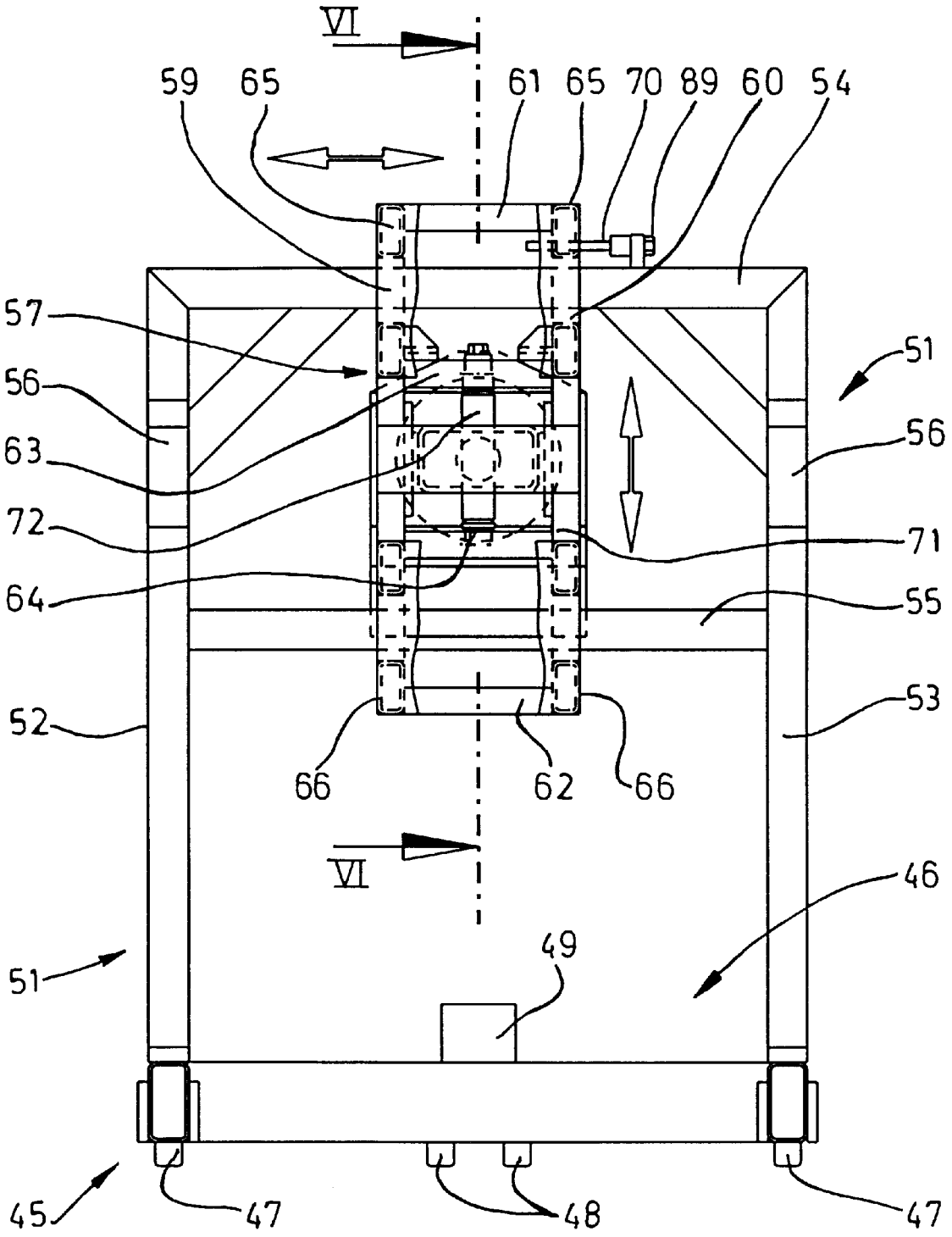
FIG. 6 shows the load-bearing means according to FIGS. 3 to 5 in front view, without folding turret.
Figure 7:
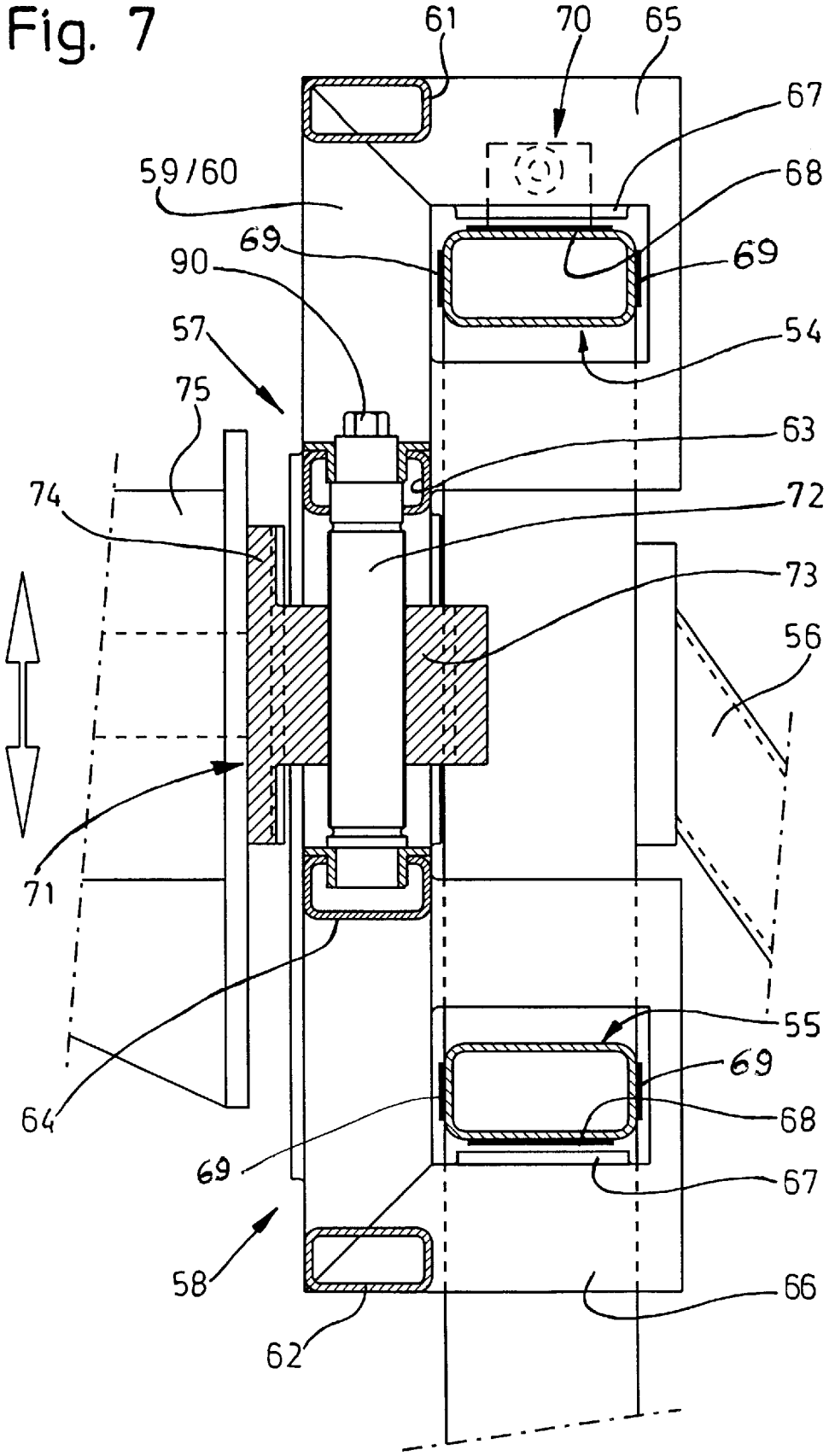
FIG. 7 shows, on an enlarged scale, a detail of the load-bearing means along a section plane VI—VI of FIG. 6.

For the second, outer sub-turret 18, a coupling device 81 adapted to the shape of said sub-turret is connected to the handling unit 45, namely to the retaining part 71 which can be moved up and down. If it is possible to separate the sub-turret 18 and supporting housing 36, the sub-turret 18 may be received as an individual part by the handling unit 45. In the case of the exemplary embodiment of FIG. 5, the unit comprising the sub-turret 18 and supporting housing 36 is positioned on the handling unit 45.

In this exemplary embodiment, the coupling device 81 comprises a load-bearing angle 82 with an upright load-bearing profile 83 and a horizontal load-bearing leg 84. The upright load-bearing profile 83 is connected to the retaining part 71 in the manner described. A bottom region of the load-bearing profile 83 is supported on the load-bearing framework 51, namely on the upright supports 52, 53, by a supporting profile 85.

On the side which faces the sub-turret 18, fastening plates 86, 87 are arranged on the upright load-bearing profile 83. These serve for the releasable fastening of the sub-turret 18 or of the supporting housing 36. In addition, the unit, namely the supporting housing 36, is supported, by way of a bottom end, on load-bearing feet 88 at the free end of the load-bearing legs 84.

In the region of the stationary installation station, the sub-turret 18 may be fitted analogously on the load-bearing structure 77.

What is claimed is:

1. A packaging machine for producing cigarette packs, comprising:

at least one rotationally driven folding turret (10) which is rotatable about an axis; and on the circumference of said folding turret, a plurality of receiving pockets (26) for packaging material and pack contents, as well as folding elements and other elements assigned to the pockets (26), wherein the folding turret (10) is subdivided in a plane perpendicular to the axial direction into at least two sub-turrets (17, 18) arranged one beside the other in the axial direction and connected releasably to one another, and wherein:

each sub-turret (17, 18) is supported at an end region thereof which is remote from the respective other sub-turret (17, 18), one sub-turret (17), which is adjacent to a machine framework (11) of the packaging machine, is supported directly on the machine framework (11), and the other sub-turret (18), which is remote from the machine framework (11), is supported by an outer, upright load-bearing, supporting housing (36) which is connected to the machine framework (11) via a bottom load-bearing part (37) extending from the machine framework (11).

2. A packaging machine for producing cigarette packs, comprising:

at least one rotationally driven folding turret (10) which is rotatable about an axis; and on the circumference of said folding turret, a plurality of receiving pockets (26) for packaging material and pack contents, as well as folding elements and other elements assigned to the pockets (26), wherein the folding turret (10) is subdivided in a plane perpendicular to the axial direction into at least two sub-turrets (17, 18) arranged one beside the other in the axial direction and connected releasably to one another, and wherein each of the sub-turrets (17, 18) comprises a fixed, non-rotatable load-bearing body (22, 28) and a rotatable body (23, 27), the load-bearing body (22, 28) of one of the sub-turrets (17) being supported on machine framework (11), and the other (18) of the sub-turrets on a supporting housing (36).

3. A packaging machine for producing cigarette packs, comprising:

at least one rotationally driven folding turret (10) which is rotatable about an axis; and on the circumference of said folding turret, a plurality of receiving pockets (26) for packaging material and pack contents, as well as folding elements and other elements assigned to the pockets (26), wherein the folding turret (10) is subdivided in a plane perpendicular to the axial direction into at least two sub-turrets (17, 18) arranged one beside the other in the axial direction and connected releasably to one another, and wherein one sub-turret (17), which faces a machine framework (11) of the machine, is supported via axis-parallel load-bearing members (14) which are connected to the machine framework (11), and which are arranged in a bottom region and grip a load-bearing body (22) of the one sub-turret (17).

4. An apparatus for producing cigarette packs, comprising:

at least one rotationally driven folding turret (10) which is rotatable about an axis:

on the circumference of said folding turret, a plurality of folding mandrels (19) and pockets (26) for packaging material and pack contents; and a plurality of folding elements, pressing-on elements and slides associated with said folding mandrels (19) and said pockets (26);

wherein said folding turret comprises:

at least a first and a second sub-turret (17, 18) disposed one beside the other in the axial direction; and coupling means releasably interconnecting said first and second sub-turrets (17, 18) to form said folding turret (10), wherein each sub-turret (17, 18) has one of said plurality of folding mandrels (19) and said plurality of pockets (26), wherein each sub-turret (17, 18) has a complete set of said folding elements, pressing-on element and slides associated with said folding mandrels (19) and said pockets (26), respectively, and wherein said folding elements, press-on elements, slides are connected exclusively to their associated ones of said first and second sub-turrets (17 or 18).

5. The apparatus according to claim 4, wherein:

the folding mandrels (19) are on said first sub-turret (17) and are adapted to receive blanks for an inner wrapper and for a cup for manufacturing cigarette packs of the soft-cup type;

the pockets (26) are on said second sub-turret (18) and are adapted to receive partially finished packs from said folding mandrels (19); and said folding turret (16) further comprises means for pushing, in the axis-parallel direction, partially finished packs, with their contents, from the folding mandrels (19) of said first sub-turret (17) to the pockets (26) of said second sub-turret (18).

6. The apparatus according to claim 4, wherein said coupling means comprises a concentric, cylindrical connecting member (33) having a diameter less than that of the sub-turrets (17, 18), and having connecting flanges (34, 25) for respectively releasably connecting the sub-turrets to the connecting part (33).

7. The apparatus according to claim 5, wherein said coupling means comprises a concentric, cylindrical connecting member (33) having a diameter less than that of the sub-turrets (17, 18), and having connecting flanges (34, 25) for respectively releasably connecting the sub-turrets to the connecting part (33).

8. The apparatus according to claim 4, further comprising a machine framework (11), wherein said first sub-turret (17) is supported directly on the machine framework (11), and said second sub-turret (18) is remote from the machine framework (11) and is supported by an outer, upright load-bearing, supporting housing (36) which is indirectly connected to the machine framework (11) via a bottom loading-bearing member (37) extending from the machine framework (11).

9. The apparatus according to claim 4, further comprising a machine framework (11), wherein each of sub-turrets (17, 18) comprises a fixed non-rotatable load-bearing body (22, 28) and a rotatable body (23, 27), each load-bearing body (22, 28) being supported on one of said machine framework (11) and a supporting housing (36) extending from said framework (11).

10. The apparatus according to claim 4, wherein:

mutually facing regions of the first and second sub-turrets (17, 18) are ring-like bodies of rotation (23, 27);

the bodies of rotation (23, 27) are spaced apart axially from one another;

each body of rotation (23, 27) is supported on a fixed load-bearing body (22, 28) of a corresponding one of the sub-turrets (17, 18); and the bodies of rotation (23, 27) of the sub-turrets (17, 18) are releasably connected to one another by a connecting member (33).

11. The apparatus according to claim 8, wherein:

the second sub-turret (18), which is remote from the machine framework (11), is partially enclosed by the supporting housing (36); and the second sub-turret (18) comprises a rotatable body which is supported in the supporting housing (36) by a sealed rotary connection (40, 41).

12. The apparatus according to claim 8, wherein the first sub-turret (17) comprises a rotating body (23) which is fitted with a sealing ring (25) to an annular sealing surface (24) of the machine framework (11).

13. The apparatus according to claim 11, wherein an enclosed region of the supporting housing (36) is connected to an oil trough (44), which is formed in a bottom region of the machine framework (11), via the load-bearing member (37) which is a hollow body.

14. The apparatus according to claim 9, wherein the first sub-turret (17), which faces the machine framework (11), is supported by axis-parallel load-bearing members (14) which are located in a bottom region and grip the load-bearing body (22) of the first sub-turret (17).

15. The apparatus according to claim 4, further comprising:

a mobile handling unit (45) for retaining and displacing a sub-turret (17, 18) which is removed from a machine framework (11), the handling unit (45) having an upright load-bearing framework (51) which is disposed on a steerable traveling mechanism (46) provided with running rollers (47, 48); and on said upright load-bearing framework (51), a retaining part (71) for releasable attachment of the sub-turret (17, 18), wherein the first sub-turret (17), which is adjacent a machine framework (11), is attachable to the handling unit (45) by a cylindrical coupling part (75) attached to the retaining part (71), and wherein the cylindrical coupling part (75) is releasably connected to the first sub-turret (17) by an exterior connecting flange (76).

16. The apparatus according to claim 4, further comprising a mobile handling unit (45) for retaining and displacing a sub-turret (17, 18) removed from the machine framework (11), wherein:

the handling unit (45) has an upright load-bearing framework (51) which is disposed on a steerable traveling mechanism (46) provided with running rollers (47, 48);

the second sub-turret (18), which is remote from a machine framework (11), is fastened, together with a supporting housing (36), on an angular coupling unit (81) of the handling unit (45);

the supporting housing (36) also is fastened to an upright load-bearing profile (83) of the coupling unit (81); and the supporting housing (36) is supported on a horizontal, bottom load-bearing leg (84) of the coupling unit (81).

17. The apparatus according to claim 15, wherein said retaining part (71) is movable in the upright direction and in a horizontal direction on a frame-like load-bearing means (57) which, in turn, is horizontally displaceable on said upright load-bearing framework (51), the retaining part (71) being mounted on said frame-like load-bearing means (57) for vertical movement relative thereto.

18. The apparatus according to claim 16, further comprising, on said upright load-bearing framework (51), a retaining part (71) for releasable attachment of the sub-turret (17, 18), wherein said retaining part (71) is movable in the upright direction and in a horizontal direction on a frame-like load-bearing means (57) which, in turn is horizontally displaceable on said upright load-bearing framework (51), the retaining part (71) being mounted on said frame-like load-bearing means (57) for vertical movement relative thereto.

* * * * *